US005304752A

United States Patent [19]

Hayashi

[11] Patent Number: 5,304,752

[45] Date of Patent: Apr. 19, 1994

[54] ELEVATOR CALL ALLOCATION SYSTEM BASED UPON PASSENGER WAITING TIME

[75] Inventor: Yuichiro Hayashi, Inazawa, Japan

[73] Assignee: Mitsubishi Denki Kabushiki Kaisha, Tokyo, Japan

[21] Appl. No.: 946,104

[22] Filed: Sep. 17, 1992

[30] Foreign Application Priority Data

Sep. 18, 1991 [JP] Japan ..... 3-238239

[51] Int. Cl.[5] ..... B66B 1/20

[52] U.S. Cl. ..... 187/126; 187/121; 187/130

[58] Field of Search ..... 187/121, 126, 127, 132, 187/131, 101, 130

[56] References Cited

U.S. PATENT DOCUMENTS

| | | | |
|---|---|---|---|
| 4,151,512 | 4/1979 | Riganati et al. . | |
| 4,244,450 | 1/1981 | Umeda et al. . | |
| 4,562,530 | 12/1985 | Umeda et al. . | |
| 4,685,538 | 8/1987 | Kamaike | 187/121 |
| 4,752,966 | 6/1988 | Schiller . | |
| 4,802,557 | 2/1989 | Umeda et al. | 187/127 |
| 4,979,594 | 12/1990 | Begle et al. | 187/121 |
| 4,982,817 | 1/1991 | Tsuji . | |

FOREIGN PATENT DOCUMENTS

| | | | |
|---|---|---|---|
| 57-156982 | 9/1982 | Japan . | |
| 57-48859 | 10/1982 | Japan . | |
| 2-5660 | 2/1990 | Japan . | |
| 0095683 | 4/1990 | Japan | 187/130 |
| 0123081 | 5/1990 | Japan | 187/139 |
| 4-129971 | 4/1992 | Japan | 187/121 |

OTHER PUBLICATIONS

Mitsubishi Product Catalog; 1990.

*Primary Examiner*—Steven L. Stephan
*Assistant Examiner*—Robert Nappi
*Attorney, Agent, or Firm*—Leydig, Voit & Mayer

[57] ABSTRACT

An elevator allocation system includes an individual identifying device provided in each elevator hall and adapted to identify individual passengers. A measurement device for measuring each individual's waiting time between the moment a hall call is registered and the moment a car reaches the relevant elevator hall on the basis of the output of the individual identifying device is provided. A first memory device is provided to store waiting times measured by the measurement device. A first computation device then obtains each individual's average waiting time on the basis of the output of the first memory device. A second memory device stores average waiting times obtained on an individual basis by the first computation device. A second computation device computes an average of the waiting times of all passengers on the basis of the output of the first memory device and a third memory device stores the average of the waiting times of all passengers obtained by the second computation device. A preferential service preferentially allocates a car to a hall call registered by any passenger who has had an individual average waiting time longer than the average waiting time of all passengers on the basis of the outputs of the second and third memory device.

8 Claims, 5 Drawing Sheets

ELEVATOR CALL ALLOCATION SYSTEM BASED UPON PASSENGER WAITING TIME

BACKGROUND OF THE INVENTION

1. Field of the Invention

This invention relates to an elevator allocation system and, in particular, to an allocation system which seeks to attain an improvement in services for passengers waiting in elevator halls.

2. Description of the Related Art

Nowadays, there is a great demand for an improvement in services for passengers waiting in elevator halls. A measure taken to meet this demand has been to allocate the cars in such a way as to reduce the average waiting time with respect to hall calls and to balance the waiting times on different floors. However, because of their irregularity, hall calls are hard to anticipate, so that passengers sometimes have to wait a long time, which is rather irritating. An elevator allocation system is a means for solving this problem, an example of which is disclosed in Japanese Patent Laid-Open No. 57-156982. In this conventional elevator allocation system, each floor of the building is provided with a detector for detecting the lapse of a predetermined period of time after the last hall call and a communicator adapted to operate in response to the output of this detector. If any long waiting period is detected, the communicator informs the relevant elevator hall accordingly.

In the conventional elevator allocation system, constructed as described above, the waiting time is not considered on an individual-basis. Thus, it may happen that the same individual is repeatedly obliged to wait a long time, with the result that the passenger becomes dissatisfied with the elevator system and annoyed. This will lead to a general dissatisfaction with the system on the part of passengers.

SUMMARY OF THE INVENTION

This invention has been made with a view toward solving the above problem. It is accordingly an object of this invention to provide an elevator allocation system which is capable of eliminating passenger dissatisfaction and impatience towards elevators.

In accordance with this invention, there is provided an elevator allocation system comprising: an individual identifying device provided in each elevator hall and adapted to identify individual passengers; measurement means for measuring the waiting time of each individual between the moment a passenger registers a hall call and the moment a car reaches the relevant elevator hall, on the basis of the output of the individual identifying device; first memory means for storing waiting times measured by the measurement means; first computation means for obtaining an average waiting time for each individual on the basis of the output of the first memory means; second memory means for storing each individual's average waiting time obtained by the first computation means; second computation means for obtaining an average of the waiting times of all passengers on the basis of the output of the first memory means; third memory means for storing the average of the waiting times of all passengers obtained by the second computation means; and a preferential service means which preferentially allocates, on the basis of the outputs of the second and third memory means, a car to a hall call registered by any passenger who has had an individual average waiting time longer than the average waiting time of all passengers.

DESCRIPTION OF THE PREFERRED EMBODIMENTS

Embodiments of this invention will now be described with reference to the drawings.

First Embodiment

Figure 1:
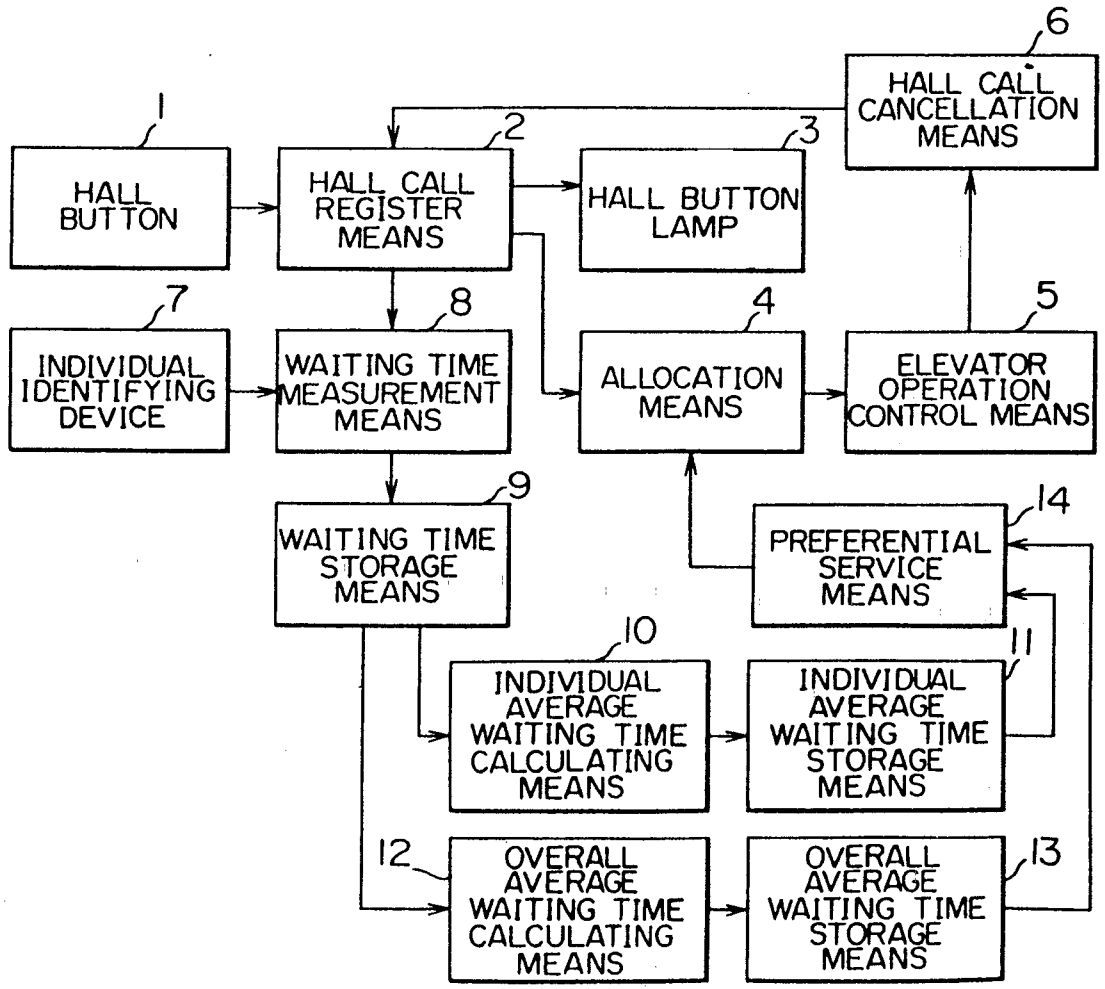
FIG. 1 is a functional block diagram showing an elevator allocation system according to a first embodiment of this invention.
Figure 2:
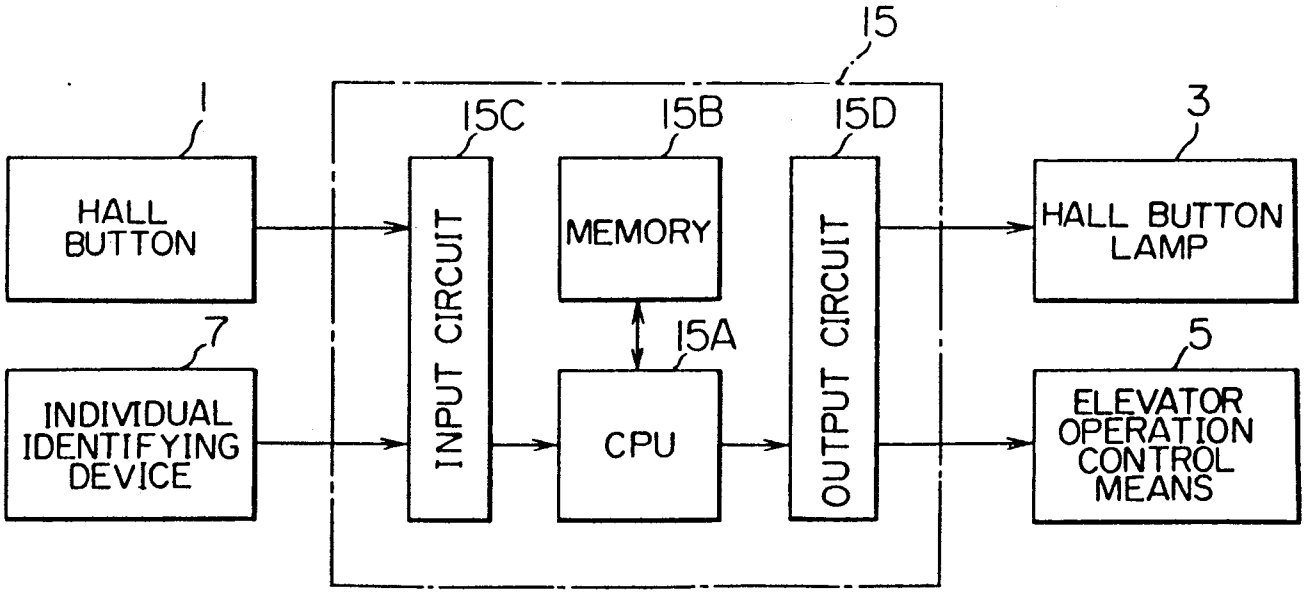
FIG. 2 is a block diagram illustrating the hardware of the allocation system of FIG. 1.

In FIG. 1, numeral 1 represents a hall button. Numeral 2 represents a hall call register means which registers a hall call upon depression of the hall button 1 and lights a hall button lamp 3. Numeral 4 represents an allocation means for optimally allocating a car upon registration of a hall call. Numeral 5 represents an elevator operation control means for dispatching an allocated car to the floor corresponding to the relevant hall call. A hall call cancellation means 6 provided between the hall call register means 2 and the elevator operation control means 5 and adapted to cancel the register of a hall call upon response of a car to the hall call. An individual identifying device for identifying individuals is provided in the proximity or on the surface of the hall button 1 and consists of, for example, a fingerprint detector (not shown) or a device adapted to receive signals from ID cards (not shown) carried by individuals. Numeral 8 represents a waiting-time measurement means for measuring each individual's waiting time between the moment a hall call is registered by an individual and the moment that hall call is cancelled, that is, the time it takes a car to arrive after the registration of a hall call. Numeral 9 represents waiting time storage means which serves as a first memory means to store each individual's waiting time an individual average waiting time calculating means 10 reads out the waiting times stored in the waiting time storage means 9 to calculate an average waiting time for every individual by dividing the sum total of the waiting times of each individual by the number of times he or she has registered a hall call. Numeral 11 represents an individual average waiting time storage means for storing each individual's average waiting time. An overall average waiting time calculating means 12 reads out and sums up the waiting times of all passengers stored in the waiting time storage means 9 to calculate an overall average waiting time by dividing the sum total of the waiting times by the total number of times a hall call is registered. Numeral 13 represents an overall average waiting time storage means for storing the overall average waiting time; A preferential service means 14 is included to supply the allocation means 4 with a command signal to allocate a car preferentially to any passenger who has had an average waiting time that is longer than the overall average waiting time. The signal is supplied on the basis of the outputs of the memory means 11 and 13, and the passenger is regarded as an object of preferential service FIG. 2 is a block diagram showing hardware for the system configuration shown in FIG. 1. In the drawing, numeral 15 indicates a microcomputer, which has a CPU 15A, a memory 15B, an input circuit 15C and an output circuit 15D. The CPU 15A includes the hall call register means 2, allocation means 4, hall call cancellation means 6, waiting time measurement means 8, individual average waiting time calculating means 10, overall average waiting time calculating means 12 and preferential service means 14, of FIG. 1. The memory 15B includes the memory means 9, 11 and 13.

Next, the operation of this allocation system will be described with reference to FIG. 3.

In step S1, a judgment is made as to whether a hall call has been registered by the hall call register means 2. When none has been registered, the system stands by. When one has been registered, the procedure advances to step S2, where a judgment is made as to whether an individual has been identified by the individual identifying device 7. In the case of a passenger who cannot be identified (for example, a passenger whose fingerprint cannot be detected or who has no identification card with him), the procedure advances to step S3, where an ordinary allocation is effected by the allocation means 4. Then, in step S4, a judgment is made as to whether a car has responded to a hall call or not by the elevator operation control means 5. If not, the system stands by. When it is verified that a car has responded to a hall call, the procedure advances to step S5, where the hall call cancellation means 6 controls the hall call register means 2 to cancel the registration of the hall call, putting out the hall button lamp 3.

When, on the other hand, a passenger is identified in step S2, the procedure advances to step S6, where waiting time count is started by the waiting time measurement means 8. Next, in step S7, the preferential service means 14 makes a judgment, on the basis of the output of the memory means 11, as to whether the passenger is an object of preferential service. If not, the allocation means 4 effects an ordinary allocation in Step S8. If the passenger is an object of preferential service, the allocation means 4 effects a preferential allocation in step S9, thus performing preferential service for the passenger.

Next, in step S10, the waiting time measurement means 8 continues the waiting time count and, in step S11, the elevator operation control means 5 makes a judgment as to whether a car has responded to the hall call. If not, the waiting time count is continued until a car responds to the hall call. When there is a response, the procedure advances to step S12, where the waiting time count by the waiting time measurement means 8 is terminated.

Next, in step S13, the waiting time storage means 9 stores waiting times on an individual basis and, in step S14, an average waiting time is calculated for each passenger by the individual average waiting time calculating means 10, storing the results in the memory means 11. Next, in step S15, an overall average waiting time with respect to all passengers is calculated by the overall average waiting time calculating means 12, storing the results in the memory means 13. Further, in step S16, the preferential service means 14 designates, on the basis of the outputs of the memory means 11 and 13, those passengers who have had an individual waiting time longer than the overall average waiting time, as objects of preferential service. Then, in step S5, the hall call cancellation means 6 controls the hall call register means 2 to cancel the hall call registration, putting out the hall button lamp 3.

Second Embodiment

Figure 4:
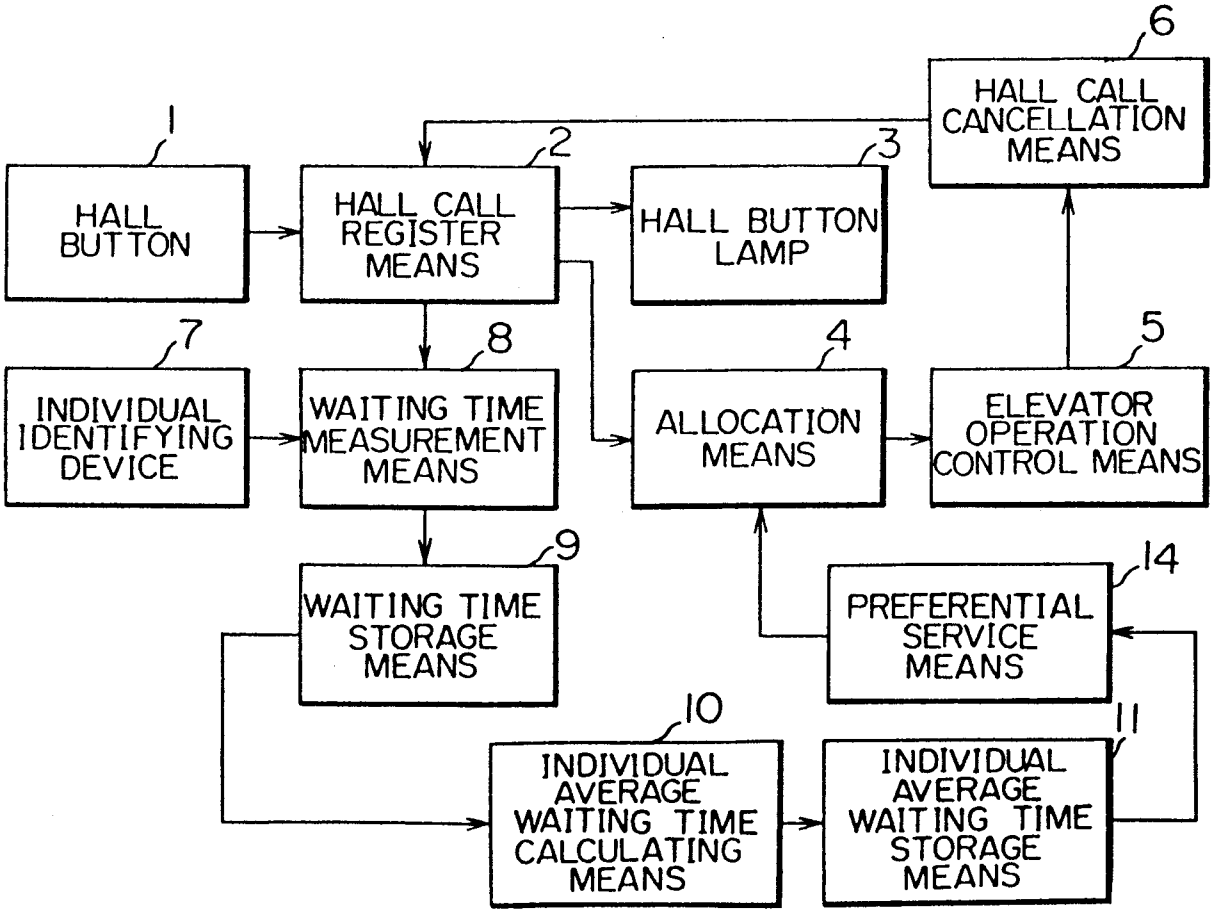
FIG. 4 is a functional block diagram showing an elevator allocation system according to a second embodiment of this invention.

FIG. 4 is a block diagram showing a second embodiment of this invention from a functional point of view. In the drawing, the components corresponding to those of FIG. 1 are referred to by the same reference numerals, and a description of such components will be omitted. This embodiment employs a preferential service means 14A instead of the preferential service means 14 of FIG. 1. The preferential service means 14A designates as objects of preferential service a predetermined number of passengers (for example, the top 10% of the passengers utilizing the system) ranked in the order of decreasing length of individual average waiting time, on the basis of the output from the individual average waiting time storage means 11. When any of those passengers utilizes the system, the preferential service means 14A operates in such a way as to generate a command signal for preferential car allocation to the allocation means 4. In this embodiment, the overall average waiting time calculating means 12 and the overall average waiting time storage means 13 of FIG. 1 need not be provided. As to the hardware configuration, this embodiment employs one which is substantially the same as that of FIG. 2.

Figure 5:
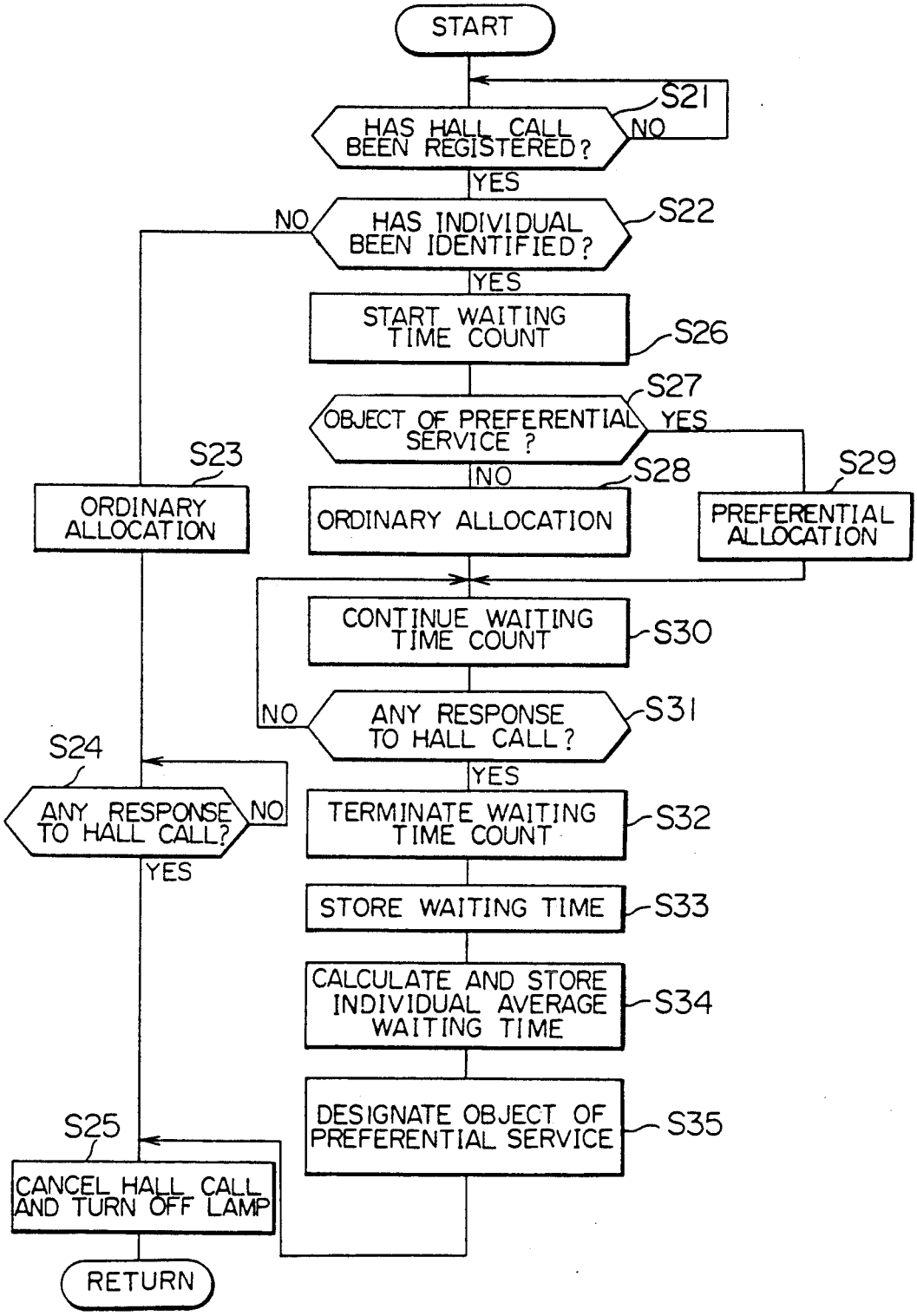
FIG. 5 is flowchart illustrating the operation of the allocation system of FIG. 4.

Next, the operation of the second embodiment will be described with reference to FIG. 5.

Figure 3:
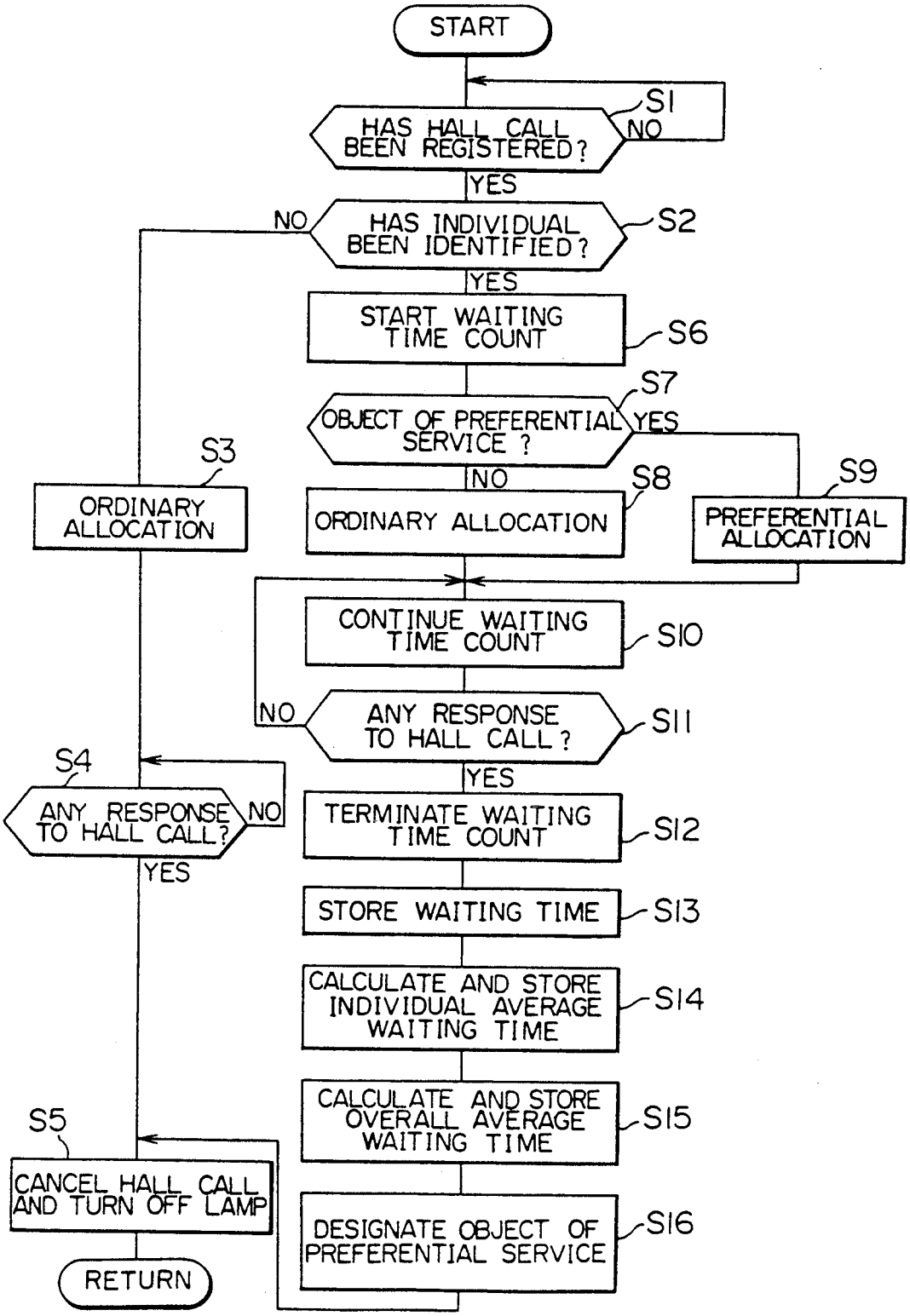
FIG. 3 is flowchart illustrating the operation of the allocation system of FIG. 1.

In the drawing, steps S21 through S34 are the same as steps S1 through S14 of FIG. 3, so an explanation thereof will be omitted. In step S35, the preferential service means 14A designates a predetermined number of passengers (for example, the top 10% utilizing the system) ranked in order of the decreasing length of individual average waiting time, as objects of preferential service. Afterwards, the procedure advances to step S25, where the hall call registration is cancelled and the hall button lamp 3 is put out, as in step S5 described above.

Third Embodiment

In the first and second embodiments, no priority order is provided among the passengers designated as objects of preferential services, so that an individual who has had the longest average waiting time does not always enjoy improved service. This problem can be solved by further ranking the passengers, designated as objects of preferential service so as to introduce a weighting in the delivery of preferential services. For example, a car may preferentially be allocated to any passenger who is among the top 5% of all passengers ranked in order of the decreasing length of individual average waiting time. Further, it will be expedient to inhibit allocation of this car to subsequent hall calls, thereby expediting car service for that passenger.

What is claimed is:

1. An elevator allocation system comprising:

an individual identifying device provided in each elevator hall and adapted to identify individual passengers;

measurement means for measuring each individual's waiting time between the moment a hall call is registered and the moment a car reaches the relevant hall on the basis of an output from said individual identifying device;

first memory means for storing waiting times measured by said measurement means;

first computation means for obtaining each individual's average waiting time on the basis of the output of said first memory means;

second memory means for storing individuals' average waiting times obtained by said first computation means;

second computation means for obtaining an average of the waiting times of all passengers on the basis of the output of said first memory means;

third memory means for storing the average of the waiting times of all passengers obtained by said second computation means; and a preferential service means which preferentially allocates, on the basis of the outputs of said second and third memory means, a car to a hall call registered by any passenger who has had an individual average waiting time that is longer than the average waiting time of all passengers.

2. An elevator allocation system according to claim 1 wherein said individual identifying device identifies individuals by detecting their fingerprints.

3. An elevator allocation system according to claim 1 wherein said individual identifying device identifies individuals on the basis of identification signals from cards carried by passengers

4. An elevator allocation system comprising:

an individual identifying device provided in each elevator hall and adapted to identify individual passengers;

measurement means for measuring each individual's waiting time between the moment a hall call is registered and the moment a car reaches the relevant hall on the basis of an output from said individual identifying device;

first memory means for storing waiting times measured by said measurement means;

computation means for obtaining each individual's average waiting time on the basis of the output of said first memory means;

second memory means for storing individuals' average waiting times obtained by said computation means; and a preferential service means which designates, on the basis of an output of said second memory means, a predetermined number of passengers as objects of preferential service, ranked in order of the decreasing length of individual average waiting time, and allocates a car preferentially to an elevator hall where any of such passengers has registered a hall call.

5. An elevator allocation system according to claim 4 wherein said preferential service means designates 10% of the passengers utilizing the system as objects of preferential service.

6. An elevator allocation system according to claim 4 wherein said preferential service means further determines a preferential order among a predetermined number of passengers who have been designated as objects of preferential service.

7. An elevator allocation system according to claim 4 wherein said individual identifying device identifies individuals by detecting their fingerprints.

8. An elevator allocation system according to claim 4 wherein said individual identifying device identifies individuals on the basis of identification signals from cards carried by passengers.

* * * * *